United States Patent [19]

Myers

[11] 4,276,457

[45] Jun. 30, 1981

[54] CIRCUIT BREAKER HAVING PLANAR CRADLE WITH EDGE PORTIONS PROVIDING RELATCHING AND CONTACT KICKER FUNCTIONS

[75] Inventor: Felix E. Myers, Cherry Hill, N.J.

[73] Assignee: Gould Inc., Rolling Meadows, Ill.

[21] Appl. No.: 62,442

[22] Filed: Jul. 30, 1979

[51] Int. Cl.[3] ..... H01H 73/50

[52] U.S. Cl. ..... 200/153 G; 335/23; 335/26

[58] Field of Search ..... 335/21, 23, 26, 22, 335/35; 200/67 B, 67 PK, 67 R, 153 G

[56] References Cited

U.S. PATENT DOCUMENTS

| | | | |
|---|---|---|---|
| 2,627,563 | 2/1953 | Thomas | 335/26 |
| 2,908,782 | 10/1959 | Kiesel et al. | 335/21 |
| 3,401,363 | 9/1968 | Vyskocil et al. | 335/23 |
| 3,488,610 | 1/1970 | Powell | 335/23 |

*Primary Examiner*—John W. Shepperd

*Attorney, Agent, or Firm*—Harold Huberfeld; Jerome M. Berliner; Bernard Gerb

[57] ABSTRACT

A narrow molded case circuit breaker is constructed with a planar cradle having an edge portion to achieve relatching and another edge portion to achieve kicking of the contact arm for weld breaking. A single bonding operation is utilized to connect the movable contact directly to a flexible conductor and at the same time simultaneously secures the movable contact and conductor to the movable contact arm. Since the movable contact is bonded directly to the flexible conductor, the movable contact arm may be constructed of steel or other relatively poor electrical conducting material.

9 Claims, 9 Drawing Figures

CIRCUIT BREAKER HAVING PLANAR CRADLE WITH EDGE PORTIONS PROVIDING RELATCHING AND CONTACT KICKER FUNCTIONS

This invention relates to narrow molded case circuit breakers in general and more particularly relates to contact arm and cradle constructions for this type of circuit breaker.

U.S. Pat. No. 2,996,589 issued Aug. 15, 1961 to F. E. Myers for a Pivoted Bimetal describes a typical prior art construction for a narrow molded case circuit breaker used for home and light industrial applications. This type of circuit breaker includes a spring operated over-center toggle type trip free contact operating mechanism in which the movable contact arm is pivoted on the manual operating handle, and the main operating spring is connected between the contact arm and the releaseable cradle. In order to affect relatching of this prior art circuit breaker the handle thereof engages a transverse pin mounted on the cradle.

Inclusion of the pin is an added expense as well as another part that requires assembly. Thus, the prior art has attempted to eliminate this resetting pin by providing a reset projection or ear formed integrally with the cradle and extending generally parallel to the pivot axis for the cradle. This formed projection has proven to be difficult to handle on the production line. Similar objections have arisen when an integrally formed ear on the cradle has been used for a kicker to break contact welds.

In order to overcome the foregoing objections of the prior art, the instant invention teaches the utilization of a planar cradle so formed that it retains relatching and contact weld breaking capabilities. In particular, according to the instant invention the relatching and contact weld breaking functions are achieved by utilizing edged surface portions of the cradle rather than forming the cradle with protruding ears or adding additional elements to the cradle. Another aspect of the instant invention provides a construction wherein a single operation fastens both the movable contact and flexible conducting braid to the movable contact arm.

Accordingly, a primary object of the instant invention is to provide a novel reduced cost construction for a relatively compact circuit breaker.

Another object is to provide a circuit breaker of this type which utilizes a planar cradle having both relatching and contact kicking formations.

Still another object is to provide a circuit breaker of this type constructed of relatively few different elements.

Still another object is to provide a circuit breaker of this type in which a single bonding operation is effective to simultaneously secure the movable contact and a flexible braid to the movable contact arm.

These objects as well as other objects shall become readily apparent after reading the following description of the accompanying drawings in which:

In FIG. 2 the circuit breaker elements are shown in the manual Off position, in FIG. 3 they are in the On position, and in FIG. 4 they are in the Tripped position.

Figure 1:
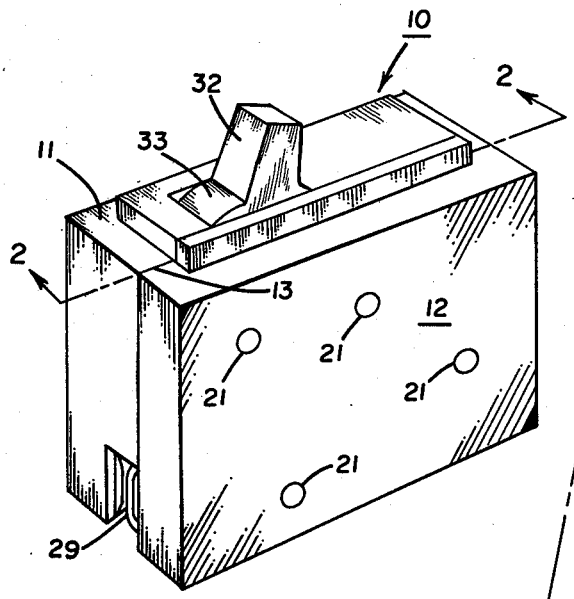
FIG. 1 is a perspective of a single pole circuit breaker constructed in accordance with teachings of the instant invention.

Now referring to the Figures and more particularly to FIGS. 1 through 6. Circuit breaker 10 is of a type described in the aforesaid U.S. Pat. No. 2,996,589. More particularly, circuit breaker 10 includes a narrow molded insulating housing consisting of base 11 and side cover 12 mating at line 13 and secured together by four rivets 21.

The current path through circuit breaker 10 consists of load terminal member 22 having wire grip 14 mounted thereto, conducting braid 23 extending from load terminal 22 to the forward end of bimetal 24, through bimetal 24 and flexible conducting braid 25 extending between the rear end of bimetal 24 and movable contact arm 26, through the latter to movable contact 27 at the rear end of arm 26, stationary contact 28 and line terminal 29 having a portion formed to constitute a female type plug-in contact engageable with a line terminal blade of a conventional panelboard. As will be hereinafter seen, the forward end of contact arm 26 is in pivotal engagement with rear or internal portion 31 of operating member 30. The latter also includes forward or external manually engageable portion 32 extending forward of housing 11, 12 through front opening 33 thereof. Main operating spring 34 is a coiled tension member secured at its rear end to contact arm 26 at aperture 92 and at its front end is secured to releasable cradle 35 at a region substantially removed from both ends thereof.

Cradle 35 is a pivotally mounted modified C-shaped element which faces rearward. Cradle pivot 36, formed integrally with base 11, is at one end of cradle 35 and latching tip 37 is at the other end thereof. In the reset position for cradle 35 (FIGS. 2 and 3), latching tip 37 is disposed forward of releaseable latch 38 and is supported by the latter. Latch 38 is mounted to bimetal 24 at a point substantially removed from pin 39 which is located near the forward end of bimetal 24 and constitutes a pivotal mounting for the latter. Mounted on bimetal 24 to the rear of latch 38 is magnetic armature 41, which under predetermined fault current conditions is attracted to relatively stationary magnetic yoke 42. When this occurs, bimetal 24 is pivoted counterclockwise to move latch 38 clear of latching tip 37 thereby releasing cradle 35 which, under the influence of operating spring 34, moves clockwise to its Tripped position of FIG. 4 in engagement with integral base formation 43. Automatic release of cradle 35 also occurs when bimetal 24 overheats so that the rear end thereof deflects sufficiently to the right to move latch 38 clear of latching tip 37.

Figure 2:
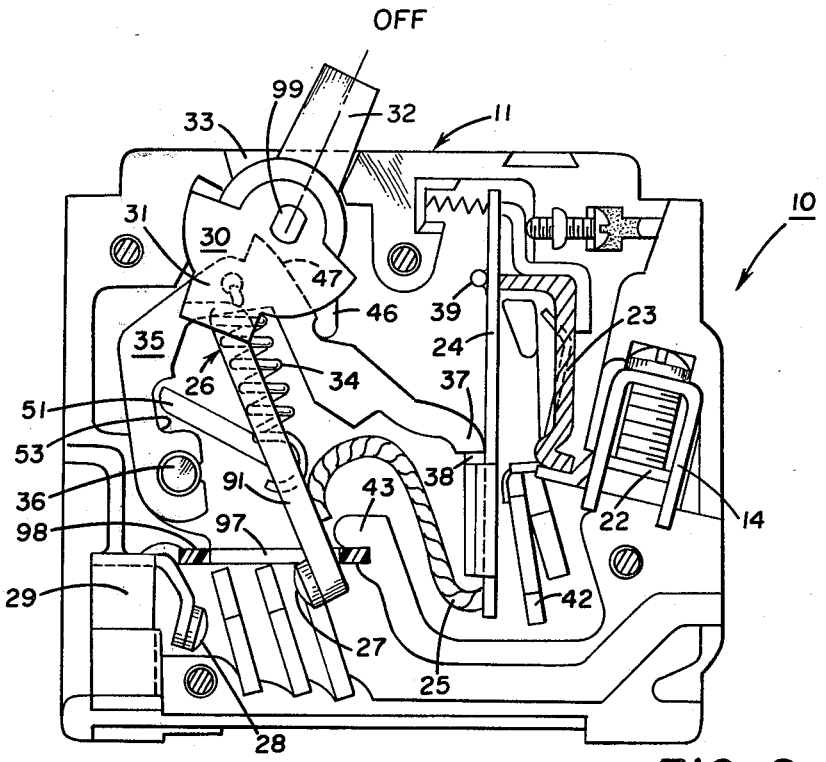
FIGS. 2, 3 and 4 are side elevations looking in the direction of arrows 2—2 of FIG. 1 with the housing cover removed to expose the current carrying and contact operating elements.
Figure 3:
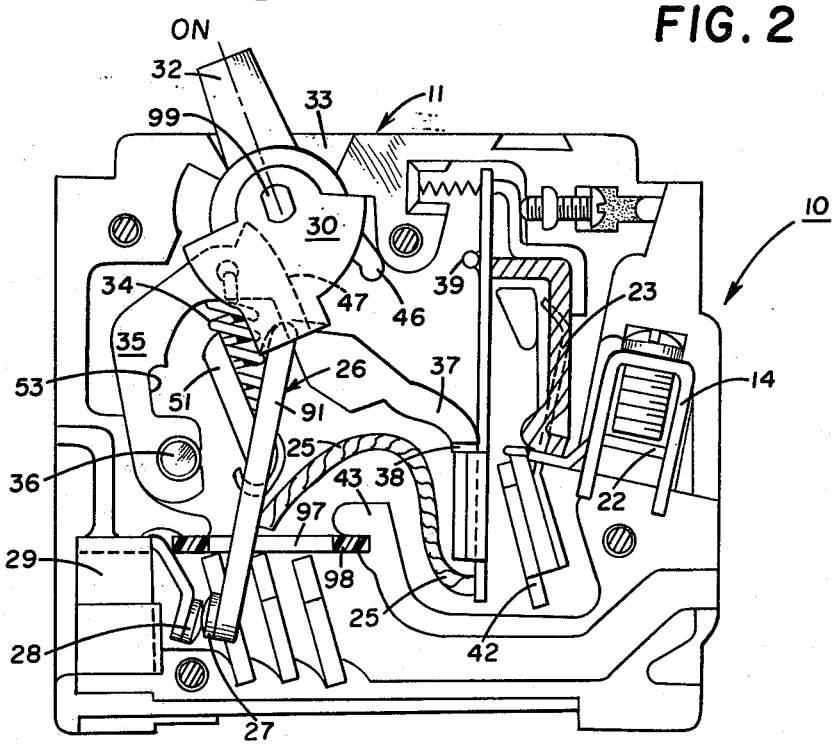

In a manner well known to the art, as operating member 30 is pivoted between circuit breaker Off and On positions of respective FIGS. 2 and 3, the forward or pivot end of contact arm 26 is moved across the line of action for main spring 34 and when this occurs the latter is effective to snap movable contact 27 either open or closed as the case may be. As this occurs the rear portion of arm 27 moves within aperture 97 of insulating barrier 98. When cradle 35 is released and spring 34 operates the circuit elements to their tripped positions shown in FIG. 4, handle portion 32 of operator 30 is in a trip indicating position generally midway between the Off and On positions shown in the respective FIGS. 2 and 3. To reset cradle 35, operator 30 is pivoted clockwise from the trip indicating position of FIG. 4 to the Off position of FIG. 2. As this occurs arcuate resetting formation 46 of operator 30 in engagement with relatching cam surface 47 along the outer edge of cradle 35 forces the latter counterclockwise about its pivot 36 to a point where latching tip 37 is forward of releaseable latch 38.

Figure 6:
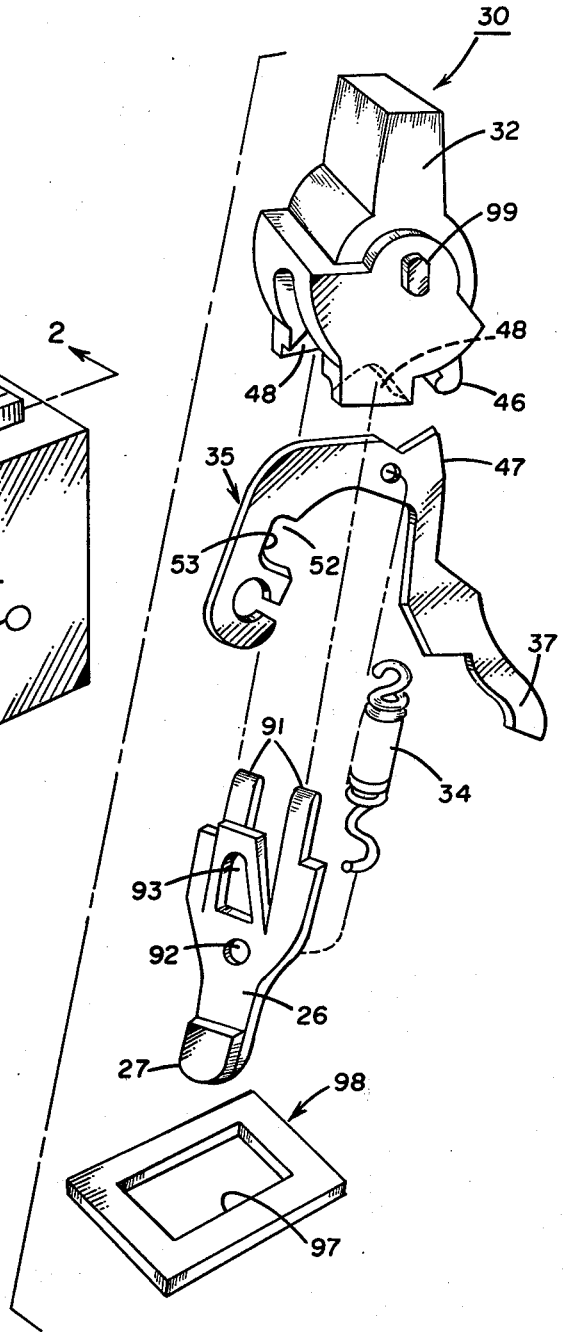
FIG. 6 is an exploded perspective of the significant elements shown in FIG. 5.
Figure 5:
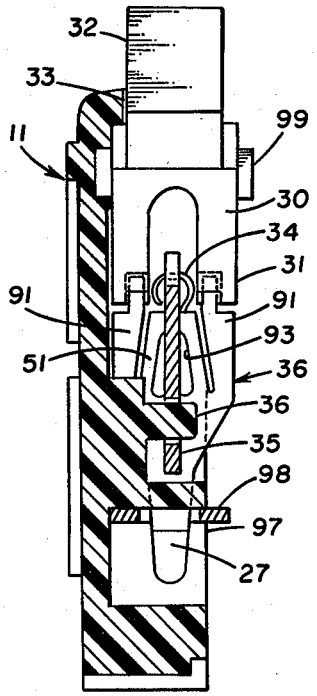
FIG. 5 is a fragmentary cross-section taken through line 5—5 of FIG. 4 looking in the direction of arrows 5—5 and showing the relationship between the contact operating elements.

As seen best in FIGS. 5 and 6, the forward end of movable contact arm 26 is bifurcated to form spaced sections 91, 91 whose free ends are forced forward by operating spring 34 to seat in spaced V notches 48, 48 of operator 30. Such notches 48, 48 constitute a pivot mounting for movable contact arm 27. This pivot mounting is repositioned on opposite sides of the line of action for operating spring 34 as operator 30 is moved on its pivot 99.

Figure 4:
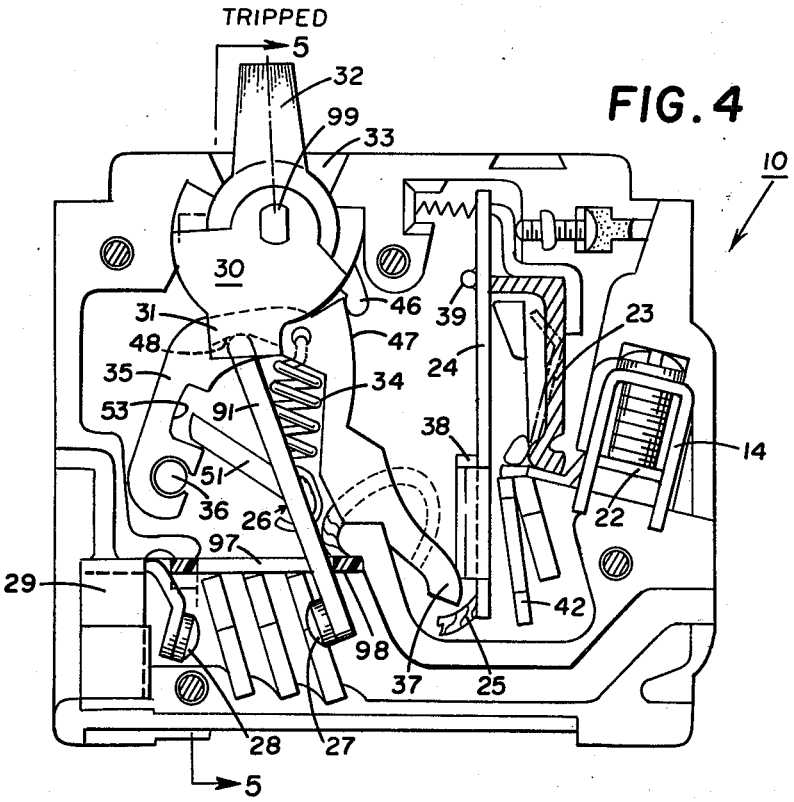

The material struck from between sections 47, 47 provides an inclined tongue 51 projecting from the face of contact arm 26 having movable contact 27 mounted thereon. The forward or free end of tongue 51 is enterable into clearance recess 52, in the inner edge of cradle 35 adjacent pivot 36, when circuit breaker 10 is tripped (FIG. 4). The main boundary defining recess 52 constitutes kicker surface 53 which engages tongue 51 to pry contacts 27, 28 apart in the event they are welded or otherwise stuck together upon the occurrence of predetermined overload conditions causing the release of latch 38. Aperture 93 in tongue 51 provides clearance for spring 34 especially when contacts 27, 28 are engaged.

Thus, it is seen that cradle 35 is a planar member formed without any protrusions, even though relatching and contact kicking functions are retained. More particularly, these functions are provided by outside edge surface 47 (relatching) and inside edge surface 53 (kicker).

Figure 7:
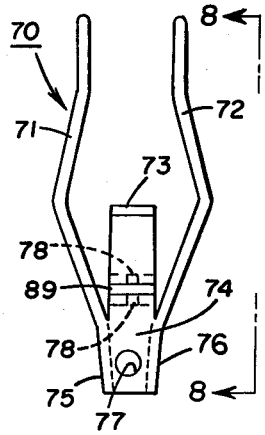
FIG. 7 is a front elevation of a contact arm constructed in accordance with another embodiment of the instant invention.
Figure 8:
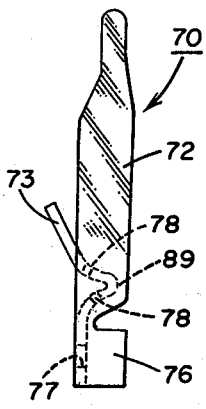
FIG. 8 is a side elevation looking in the direction of arrows 8—8 of FIG. 7.
Figure 9:
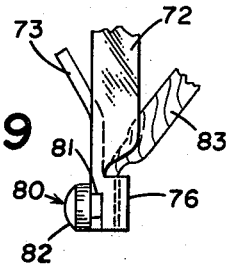
FIG. 9 is a fragmentary side elevation looking in the direction of arrows 8—8 of FIG. 7 and showing a movable contact and flexible braid mounted on the contact arm of FIG. 7.

Now referring more particularly to FIGS. 7 and 8 which show a modified construction for a movable contact arm. More particularly, movable contact arm 70 of FIGS. 7 and 8 is constructed of steel or other relatively poor electrical conducting sheet material bent to provide forwardly extending elongated bearing sections 71, 72 which face one another. A comparison of FIGS. 7 and 8 shows that the faces of sections 71, 72 are much wider than the thickness of the material from which contact arm 70 is formed. Forwardly extending kicker tongue 73 projects from the main contact carrying portion 74 of arm 70. Tongue 73 is bent in one direction with respect to portion 74 while sections 71, 72 are bent in the opposite direction from portion 74. Spaced parallel ears 75, 76 are disposed to the rear of the respective sections 71, 72 for reasons to be hereinafter explained. Section 74 is provided with contact mounting aperture 77 and V-shaped depression 89 having spring holding apertures 78, 78.

Reduced diameter portion 81 projects from the surface of contact member 80 opposite contact engaging surface 82 thereof and extends into mounting aperture 77. Extending between ears 75, 76 is one end of flexible conducting braid 83 which is bonded directly to contact 80 at junction 84 by a brazing or other suitable operation. This operation which connects contact 80 to braid 83 also mechanically secures these elements to contact arm 70. After the brazing operation, ears 75, 76 may be crimped over braid 83, as shown, to clamp the latter and protect the connection between contact 80 and braid 83.

Although a preferred embodiment of this invention has been described, many variations and modifications will now be apparent to those skilled in the art, and it is therefore preferred that the instant invention be limited not by the specific disclosure herein, but only by the appending claims.

What is claimed is:

1. A circuit breaker including a stationary contact, a movable contact, a movable contact arm, an operating member, a contact operating spring, a releaseable cradle, releasable latch means for holding said cradle in a reset position, and a narrow housing to which said member and said cradle are movably mounted on respective first and second pivots extending widthwise of said housing; said operating member including a manually engageable forward portion disposed externally of said housing at the front thereof and a rear portion within said housing connected at a third pivot to said arm at its forward end; said movable contact being at the rear of said arm and being engageable with and disengageable from said stationary contact; said spring being connected to said cradle and said arm, and exerting a force component urging said arm forward; with said cradle in said reset position, as said member moves between circuit breaker Open and Closed positions, said third pivot being moved to opposite sides of the line of action for said spring whereby the latter operates said arm to respectively disengage and engage said contacts; with said cradle released by said latch means, said spring operates said cradle to a tripped position and said member to a trip indicating position intermediate said Open and Closed positions; said cradle being a relatively thin planar member; said rear portion of said operating member including a reset formation engageable with a resetting edge formation integrally formed with said cradle whereby with said cradle tripped, operation of said member from said trip indicating position to said Off position causes said reset formation to engage said resetting edge and thereby move said cradle to said reset position; said cradle further including a latching tip engageable by said latch means; said tip and said first pivot being at opposite ends of said cradle; said spring being connected to said cradle at a connecting point intermediate the ends of said cradle; and said resetting edge formation being disposed between said tip and said connecting point.

2. A circuit breaker as set forth in claim 1 in which the cradle is of modified C-form, facing generally rearward, and the resetting edge formation is disposed along the outer edge thereof.

3. A circuit breaker as set forth in claim 2 in which the reset formation includes an arcuate surface of relatively small diameter.

4. A circuit breaker as set forth in claim 1 in which the cradle is constructed of thin sheet material and said resetting edge formation is disposed within the plane of said sheet material.

5. A circuit breaker as set forth in claim 1 in which the contact arm includes a bifurcated portion at the end of said arm opposite said movable contact; said bifurcated portion having spaced sections engaging said operating member at said second pivot and between which said cradle extends; said cradle also including a kicker edge portion; said contact arm having a tongue projecting from the side of said arm having said movable contact thereon; with said latch means released and said contacts welded or otherwise held in engagement; said kicker edge portion engaging said tongue with a kick directed in the contact opening direction.

6. A circuit breaker as set forth in claim 5 in which the kicker edge portion is disposed in the vicinity of the first pivot.

7. A circuit breaker as set forth in claim 6 in which the cradle is of modified C-form, facing generally rearward, and the resetting edge formation is disposed along the outer edge thereof; and the kicker edge formation is disposed along the inner edge thereof.

8. A circuit breaker as set forth in claim 7 in which the cradle is provided with a recess in the inner edge thereof, said kicker edge formation defining part of said recess; which said cradle in said reset position and said contacts engaged, said tongue having the free end thereof disposed in said recess.

9. A circuit breaker as set forth in claim 5 in which the cradle is constructed of thin sheet material; said resetting edge formation and said kicker edge formation being disposed within the plane of said sheet material.

* * * * *